United States Patent [19]

Runyan et al.

[11] Patent Number: 5,052,298

[45] Date of Patent: Oct. 1, 1991

[54] INK CONTROL SYSTEM

[75] Inventors: Steven Runyan, Los Altos Hills; Jerry D. Haney, Sunnyvale; James R. Francy, Los Gatos, all of Calif.

[73] Assignee: Graphics Microsystems, Mountain View, Calif.

[21] Appl. No.: 611,477

[22] Filed: Nov. 7, 1990

Related U.S. Application Data

[60] Continuation of Ser. No. 371,996, Jun. 27, 1989, abandoned, which is a division of Ser. No. 98,745, Sep. 16, 1987, Pat. No. 4,864,930, which is a continuation of Ser. No. 733,208, May 9, 1985, abandoned.

[51] Int. Cl.[5] ..... B41F 31/04; B41F 31/06

[52] U.S. Cl. ..... 101/365

[58] Field of Search ..... 101/350, 250, 365, 207, 101/208, 209, 210; 364/521, 235, 235.7

[56] References Cited

U.S. PATENT DOCUMENTS

| | | |
|---|---|---|
| 1,798,042 | 3/1931 | Smith . |
| 1,905,104 | 4/1933 | Kerr . |
| 2,837,024 | 6/1958 | Dougan . |
| 3,057,294 | 10/1962 | Jameson . |
| 3,134,325 | 5/1964 | Worthington et al. . |
| 3,185,088 | 5/1965 | Norton . |
| 3,186,339 | 6/1965 | Turner et al. . |
| 3,318,239 | 5/1967 | Wintzer . |
| 3,330,393 | 7/1967 | Heimlicher . |
| 3,696,743 | 10/1972 | Johne et al. . |
| 3,702,587 | 11/1972 | Lee . |
| 3,727,550 | 4/1973 | Easoz et al. . |
| 3,730,090 | 5/1973 | Lamberg et al. . |
| 3,747,524 | 7/1973 | Crum . |
| 3,771,447 | 11/1973 | Easoz et al. . |
| 3,774,536 | 11/1973 | Raymond et al. . |
| 3,779,165 | 12/1973 | Abendroth et al. . |
| 3,792,659 | 2/1974 | Albrecht . |
| 3,820,459 | 6/1974 | Paul . |
| 3,835,771 | 9/1974 | Funk et al. . |
| 3,835,777 | 9/1974 | Krygeris . |
| 3,853,409 | 12/1974 | Gaillochet . |
| 3,855,927 | 12/1975 | Simeth . |
| 3,877,369 | 4/1975 | D'Amato et al. . |
| 3,913,479 | 10/1975 | Cappel et al. . |
| 3,922,966 | 12/1975 | Despot . |
| 3,930,447 | 1/1976 | Murray . |
| 3,958,509 | 5/1976 | Murray et al. . |
| 3,968,746 | 7/1976 | Gaillocher . |
| 3,978,788 | 9/1976 | Cappel et al. . |
| 3,995,958 | 12/1976 | Pfahl et al. . |
| 4,000,694 | 1/1977 | Schroder . |
| 4,000,695 | 1/1977 | Perretta . |
| 4,040,349 | 8/1977 | Jeschke . |
| 4,050,380 | 9/1977 | Pfizenmaier . |
| 4,051,782 | 10/1977 | Fernandez . |
| 4,126,091 | 11/1978 | Cohen . |
| 4,200,932 | 4/1980 | Schramm et al. . |
| 4,213,390 | 7/1980 | Liebert et al. . |
| 4,242,958 | 1/1981 | Jeschke . |
| 4,270,441 | 6/1981 | Perretta . |
| 4,281,597 | 8/1981 | Dressler . |
| 4,314,506 | 2/1982 | Rees . |
| 4,318,341 | 3/1982 | Pietsch et al. . |
| 4,328,748 | 5/1982 | Schramm . |
| 4,329,923 | 5/1982 | Iida . |
| 4,366,542 | 12/1982 | Anselrode ..... 101/18.1 |
| 4,390,958 | 6/1983 | Mamberer ..... 101/350 |
| 4,392,429 | 7/1983 | Forster et al. . |
| 4,398,465 | 8/1983 | Pozin . |
| 4,639,881 | 1/1987 | Zingher ..... 364/521 |
| 4,864,930 | 9/1989 | Runyan et al. ..... 101/365 |

FOREIGN PATENT DOCUMENTS

| | | |
|---|---|---|
| 0113905 | 7/1984 | European Pat. Off. . |
| 3220360 | 12/1983 | Fed. Rep. of Germany . |
| 3220803 | 12/1983 | Fed. Rep. of Germany . |
| WO83/04219 | 12/1983 | PCT Int'l Appl. . |
| 2024457 | 1/1980 | United Kingdom . |

*Primary Examiner*—J. Reed Fisher

*Attorney, Agent, or Firm*—Limbach, Limbach & Sutton

[57] ABSTRACT

For use with a printing apparatus that has a plurality of printing rollers, at least one ink fountain, and at least one inking blade that is positioned adjacent one of the inking rollers, the inking blade having a plurality of adjusting keys thereon, an ink control system connected to the inking blade for controlling the adjustment the adjusting keys. The ink control system comprises a system unit for controlling the overall operation of the ink control system, an operator console for inputting commands which control the adjustment of the adjusting keys, a servo powder unit for controlling the adjustment of the adjusting keys, and a plurality of servo modules each of which performs the adjustment of one of the adjusting keys by actuating the one adjusting key.

5 Claims, 11 Drawing Sheets

INK CONTROL SYSTEM

This is a continuation of co-pending application Ser. No. 371,996 filed on June 27, 1989, now abandoned, which is a divisional of application Ser. No. 098,745, filed Sept. 16, 1987 (now U.S. Pat. No. 4,864,930), which is a continuation of parent application Ser. No. 733,208, filed May 9, 1985, now abandoned.

1. Technical Field

This invention relates to printing apparatus, and more particularly, to ink control systems.

2. Background Art

Printing apparatus are common in the art. Printing apparatus generally comprises a plurality of printing rollers, at least one ink fountain, and at least one inking blade that is positioned adjacent to one of the inking rollers. The inking blade is a generally longitudinally extending member the longitudinal length of which being generally parallel with the axis of the inking roller. One edge of the inking blade is positioned adjacent to, but not continguous with, the inking roller such that a gap is formed between the inking blade edge and the inking roller. The distance of the gap is varied by adjusting the position of the inking blade in relation to the inking roller. The distance between the inking blade and the inking roller is proportional to the amount of ink that may be adhered to the inking roller, which in turn determines the intensity of the ink that is printed on a medium, generally paper.

Since the intensity of the ink may not be uniform across a single piece of print, the distance of the gap between the inking blade and the inking roller needs to, necessarily, be different at different locations along the entire length of the inking roller. The adjustment of the gap at each discrete location is generally performed by manually-operated adjusting devices which are mounted on the inking blade. Each of these adjusting devices varies the intensity of the ink on a segment of the resultant print, generally referred to as a zone. The adjusting devices in the prior art are generally referred to as keys. Examples of such prior art printing apparatus and ink adjusting devices are illustrated in Crum, U.S. Pat. No. 3,747,524; Murray, et al., U.S. Pat. No. 3,958,509; Crum et al., U.S. Pat. No. 4,008,664; and Schramm, U.S. Pat. No. 4,328,748.

DISCLOSURE OF THE INVENTION

In view of the prior art, it is a major object of the present invention to provide an ink control system that is capable of being readily retrofitted onto any existing printing apparatus, especially the capability to be retrofittable irrespective of the proportionality between the number of keys and the number of zones.

It is another object of the present invention to provide an ink control system that utilizes simple and rapid communications techniques, especially the use of buses to communicate with the adjusting devices.

It is a further object of the present invention to provide an ink control system that does not require the alteration of an existing printing apparatus.

It is another object of the present invention to provide an ink control system that utilizes simple feedback techniques to sense the movement of the adjusting keys.

It is a still further object of the present invention to provide an ink control system that is capable of storing and recalling a job.

It is another object of the present invention to provide an ink control system that is capable of preventing damages to the printing apparatus.

It is a still further object of the present invention to provide an ink control system that is modularly expandable or contractable in order to match the dimension of an existing printing apparatus.

It is another object of the present invention to provide an ink control system that is easy to install and remove from an existing printing apparatus.

In order to accomplish the above and still further objects, the present invention provides an ink control system for use with a printing apparatus that has a plurality of printing rollers, at least one ink fountain, and at least one inking blade that is positioned adjacent one of the inking rollers, the inking blade having a plurality of adjusting keys thereon. The ink control system for controlling the adjustment the adjusting keys comprises a system unit for controlling the overall operation of the ink control system, an operator console for inputting commands which control the adjustment of the adjusting keys, a servo power unit for controlling the adjustment of the adjusting keys, and a plurality of servo modules each of which performs the adjustment of one of the adjusting keys by actuating the one adjusting key.

Other objects, features, and advantages of the present invention will appear from the following detailed description of the best mode of a preferred embodiment, taken together with the accompanying drawings.

BEST MODE FOR CARRYING OUT THE INVENTION

Figure 1:
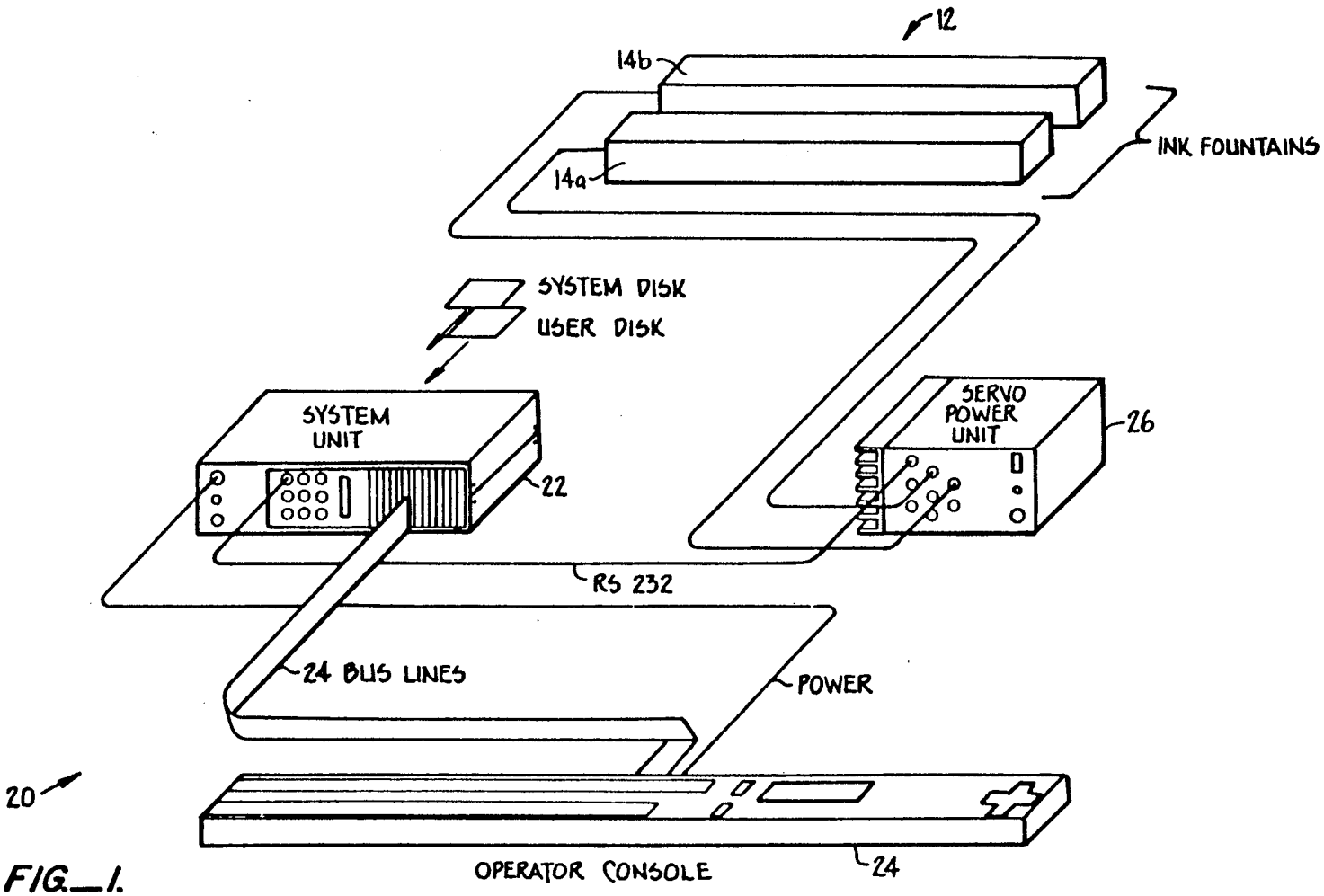
FIG. 1 is a simplified, perspective view of the ink control system of the present invention.
Figures 2, 3:
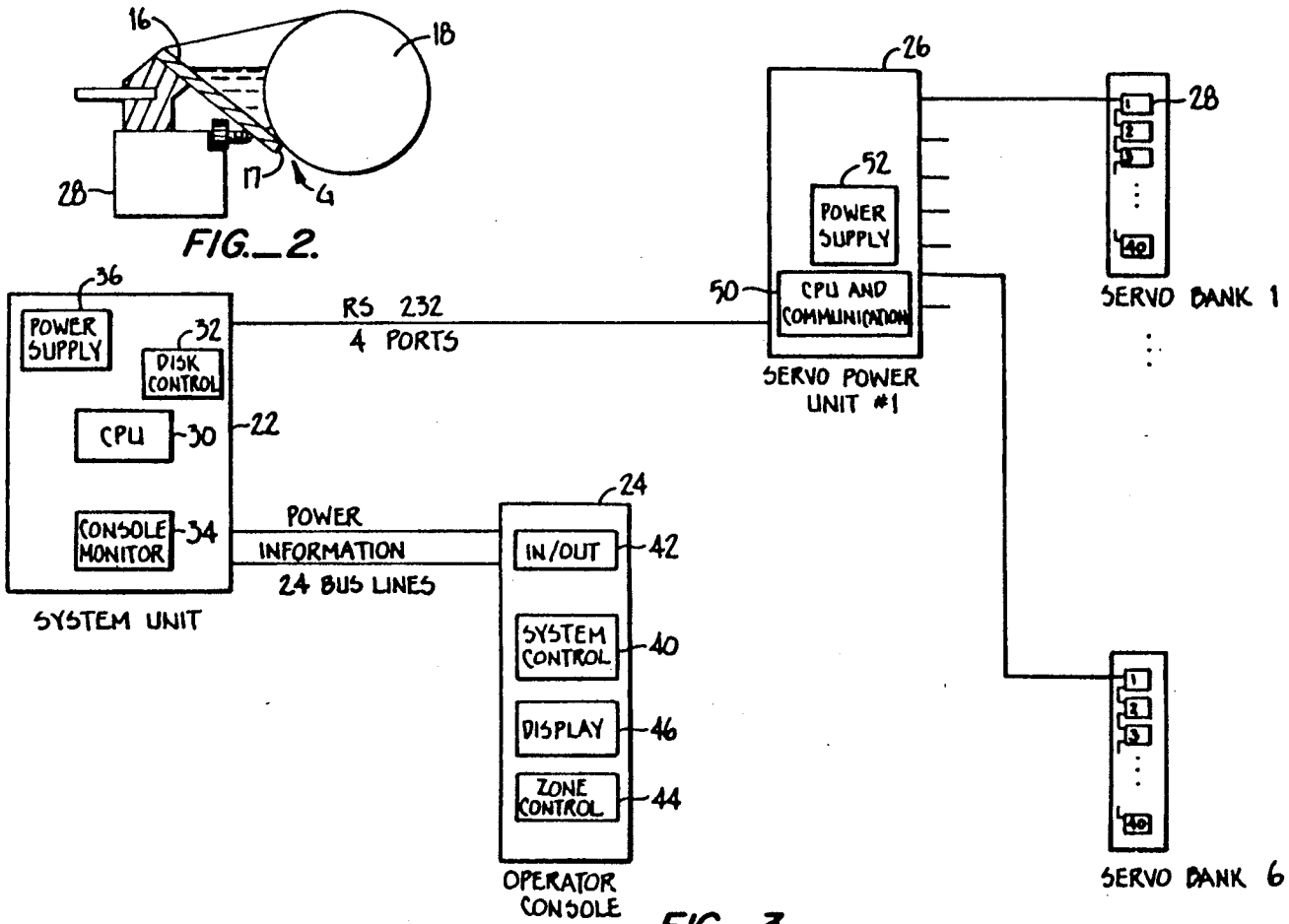
FIG. 2 is a simplified, cross section view of the servo module of the present invention, as it is connected to an ink fountain.
FIG. 3 is a simplified, block diagram of the ink control system of FIG. 1.
Figure 4:
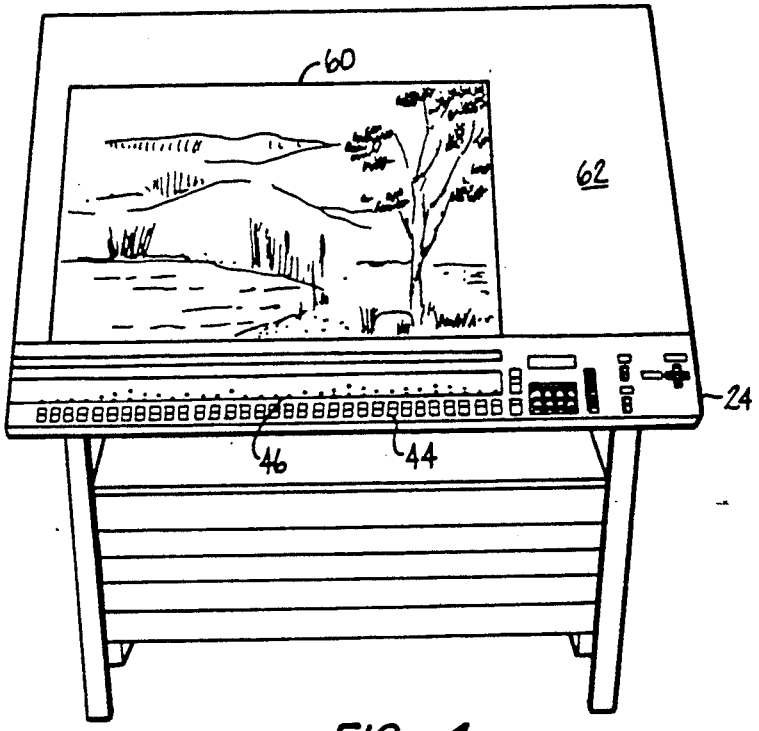
FIG. 4 is a perspective view of the operator console of the present invention.

Referring to FIG. 1, there is shown, in a diagrammatical fashion, a conventional offset printing apparatus, generally designated 12. Printing apparatus 12 includes, in this illustration, two ink fountains 14*a* and 14*b*. Each of the ink fountains 14*a* and 14*b*, which are also of conventional design, has at least one inking blade 16 and at least one inking roller 18, as best shown in FIG. 2. Each of the ink fountains 14*a* and 14*b* is used for dispensing ink of a particular color. Inking blade 16 is a generally longitudinally extending member the longitudinal length of which being generally parallel with the axis of inking roller 18. One edge 17 of inking blade 16 is positioned adjacent, but not contiguous, to inking roller 18 such that a gap G is formed between inking blade edge 17 and inking roller 18. The distance of this gap G is varied by adjusting the position of inking blade 16 in relation to inking roller 18. The distance between inking blade 16 and inking roller 18 is proportional to the amount of ink that may be adhered to inking roller 18, which in turn determines the intensity of ink that is printed on a medium, generally paper. For example, the smaller the gap G between inking blade edge 17 and inking roller 18 means that a lesser amount of ink may be picked up by inking roller 18 such that the resultant printing is light in intensity To vary the intensity of the ink on a single piece of resultant print, the gap G between inking blade 16 and inking roller 18 may be adjusted to have a different distance at each of several different, discrete locations along the entire length of inking roller 18. This is accomplished in the prior art by adjusting inking blade 16 at those discrete locations. An adjusting device is mounted at each of these locations on inking blade 16. These adjusting devices in the prior art are manual-operating mechanisms. Adjusting the entire plurality of these devices, generally in the order of at least a dozen for a small ink fountain and up to three dozen for a larger fountain, is both time consuming and inaccurate. Time consuming in that an operator needs to adjust and re-adjust most if not all of these devices by trial and error. Inaccurate in the sense that the operator is adjusting these devices based on his prior experiences to produce shadings of the resultant color. Moreover, the resultant adjustments may not be reproducible for a future printing run.

Figure 5:
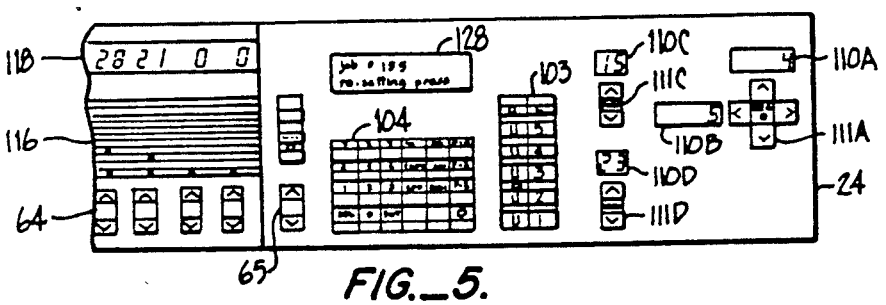
FIG. 5 is a partial, enlarged view of the operator console of FIG. 4.
Figure 11:
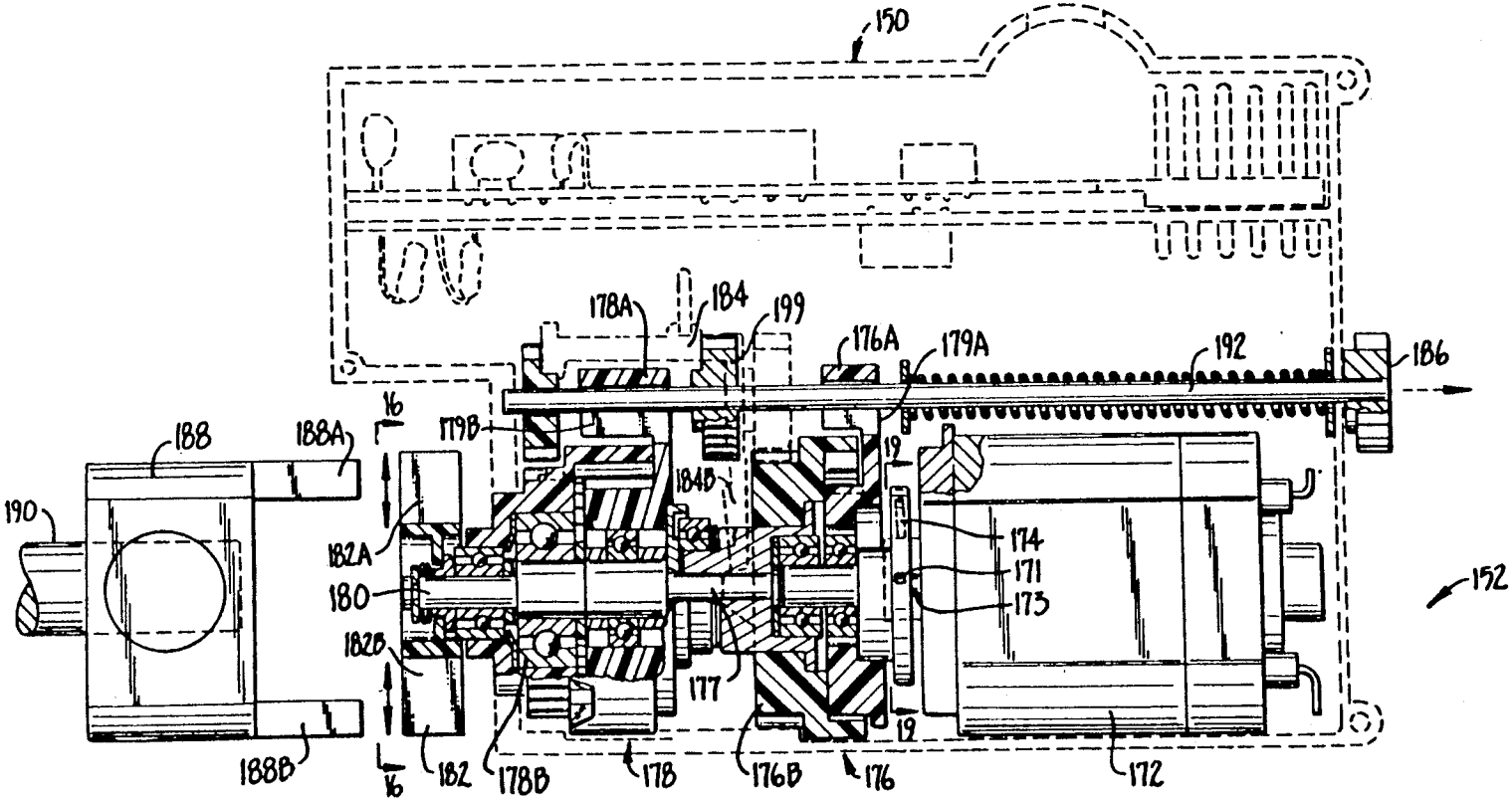
FIG. 11 is a partial, cross section view of the servo drive unit of the servo module of FIG. 2.

To alleviate these and other disadvantages, an inking control system is disclosed, designated 20, as best shown in FIG. 1. Inking control system 20 is basically an attachment to an existing conventional printing apparatus 12. An example of an existing conventional printing apparatus 12 is the Bestech 40 printing apparatus manufactured by Akiyama Printing Machinery Manufacturing Corp. of Tokyo, Japan. Control system 20 comprises a system unit 22, an operator console 24, a plurality of servo power units 26 each of which in turn controls a plurality of servo modules 28. Each servo module 28 is the mechanism that adjusts the gap G between inking blade 16 and inking roller 18 at a particular discrete location on inking blade 16, as best shown in FIG. 5. Each servo module 28 is mounted on inking blade 16 at a predetermined location of inking blade 16. That predetermined location, as best shown in FIG. 11, is the location of an existing key 190 that is in contact with inking blade 16. The actions of servo modules 28 affect areas of the resultant print, these areas being generally referred to as ink zones. As described below, the number of ink zones need not correspond to the number of keys 190, i.e., the number of servo modules 28.

The broad, overall operation of control system 20 is best illustrated in FIG. 3. System unit 22 includes central processing means 30, a disc controller 32, console monitoring means 34, and a conventional power supply 36. As for operator console 24, it includes system control means 40, input/output control means 42, zone control means 44, and display means 46. Each servo power unit 26 includes servo central processing and communication means 50 and a conventional power supply 52. As described below, system 20 utilizes distributed processing wherein operations pertaining to a subunit such as servo power unit 26 are performed to a large degree under the guidance of an internal processing means rather than entirely under the guidance of central processing means 30.

In operation, a template or etched plate 60 of the image to be printed is first placed on an easle-like platform 62. Plate 60 has been etched by conventional methods. Operator console 24 is generally positioned at the lower portion of platform 62 such that plates 60 or resultant prints may be easily viewed in conjunction with the various displays of display means 46. An operator first initializes servo modules 28 by selecting a zero setting on zone control means 44. Zone control means 44 comprises a plurality of switches 64 each of which may be used to select the intensity of the ink that appears on a zone of the resultant print. In essence, the selected intensity eventually affects the movement of servo module 28 as it controls the gap G between inking blade 16 and inking roller 18 at a discrete location of inking blade 16. The selected intensity is verified both as a numerical display and a graphical display on display means 46. System control means 40 then transforms this information into the appropriate signals for transmission by input/output control means 42.

Receiving the zone intensity information from operator console 24, central processing means 30 of system unit 22 performs several functions. First, central processing means 30 is capable of storing that information in a storage device, not shown, via disc controller 32. Next, central processing means 30 is capable of outputting commands to servo power unit 26. Console monitoring means 34 is provided to control the transfer of information between system unit 22 and operator console 24.

As for the commands forwarded by system unit 22 to servo power unit 26, they are received by central processing and communication means 50. Central processing and communication means 50 transforms these commands into appropriate signals such as pulses for servo module 28. These pulses causes an internal motor of servo module 28 to widen or narrow the gap G between inking blade 16 and inking roller 18.

Although ink control system 20 is capable of having four servo power units, the preferred embodiment utilizes only one such servo power unit 26. Each servo power unit 26 in turn controls six groups or banks of servo modules 28. Each bank of servo modules 28 may vary from 22 to 40 servo modules 28.

To describe ink control system 20 in greater detail, each subunit will now be described in seriatim.

SYSTEM UNIT

As shown in FIG. 3, system unit 22 comprise central processing means 30, a disc controller 32, console monitoring means 34, and a power supply 36. Since central processing unit 30, disc controller 32, and power supply 36 are implemented from conventional devices in the preferred embodiment, they will not be described in further detail. In actuality, these enumerated elements in the preferred embodiment utilize the appropriate subunits of an IBM-compatible personal computer. For example, central processing means 30 of the preferred embodiment is an 8088 microprocessor manufactured by Intel Corp. of Santa Clara, Calif.

Figure 7:
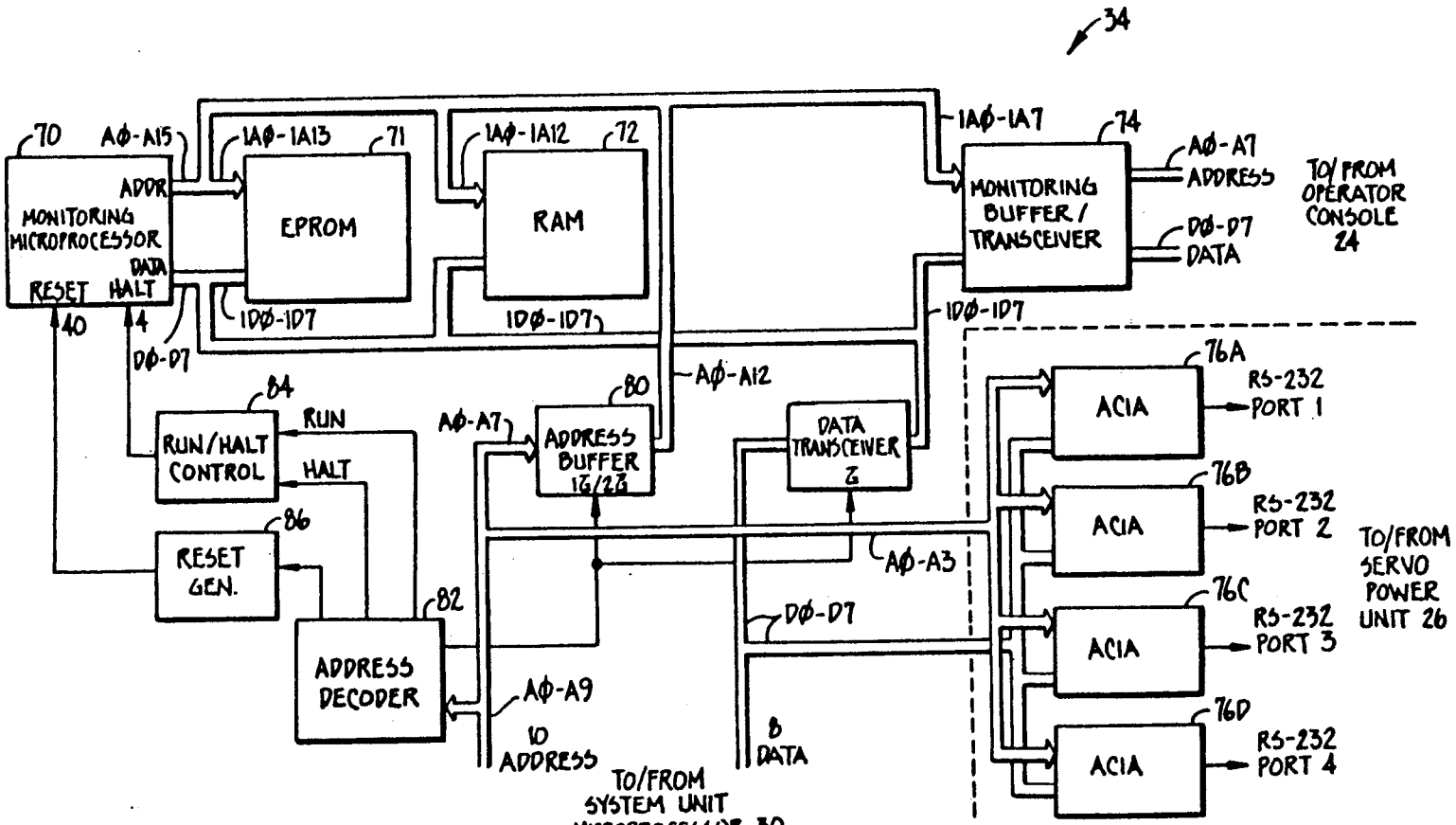
FIG. 7 is a block diagram illustrating portions of the system unit of FIG. 3.

As best shown in FIG. 7, console monitoring means 34 comprises monitoring processing means 70, a programmable read only memory (EPROM) 71, a random access memory (RAM) 72, a monitoring buffer/transceiver 74, a bi-directional data transceiver 78, an address buffer 80, an address decoder 82, run/halt control means 84, and reset generator means 86.

More particularly, monitoring processing means 70 in the preferred embodiment is a 6802 microprocessor manufactured by Motorola Inc. of Phoenix, Ariz. Microprocessor 70 includes sixteen address outputs, eight data outputs, a reset input, and a halt input. EPROM 71 and RAM 72 each has eight data lines and fourteen and thirteen address inputs, respectively. EPROM 71 in the preferred embodiment is a conventional 8-bit, 128K memory device. Similarly, RAM 72 is a conventional 8-bit, 64K memory device. Monitoring buffer/transceiver 74 includes address and data lines which communicate with console monitoring means 34 and corresponding address and data lines which communicate with operator console 24. Monitoring buffer/transceiver 74 in the preferred embodiment utilizes 74LS244 buffer and 74LS245 transceiver, all manufactured by Signetics Corp. of Sunnyvale, Calif.

Data transceiver 78 is provided for receiving and transmitting the 8-bit data information between console monitoring means 34 and central processing means 30, i.e., system unit microprocessor 30. Similarly, address buffer 80 is provided for transmitting address information from system unit microprocessor 30 to console monitoring means 34. Both data transceiver 78 and address buffer 80 include a control port which is in communication with address decoder 82. Data transceiver 78 and address buffer 80 in the preferred embodiment is the 74LS245 transceiver and 74LS244 buffer, respectively. Address decoder 82 is provided for generating three signals which in turn produce the HALT-/RUN signal of run/halt control means 84 and the RESET signal of reset generator means 86. Address decoder 82 in the preferred embodiment utilizes the 74LS138 decoders/demultiplexers manufactured by Signetics. Run/halt control means 84 and reset generator means 86 are of conventional design, utilizing the 74LS74 D-Type Flip-flops manufactured by Signetics.

As also shown in FIG. 7, system unit 22 also includes a plurality of asynchronous communication interface adapters (ACIA's) 76A through 76D to facilitate the communication between system unit 22 and servo power unit 26. Each of the ACIA's 76A through 76D is provided to permit the transmission of information from system unit microprocessor 30 to a servo power unit 26. Each ACIA includes four address inputs and eight data lines from system unit microprocessor 30. In addition, each ACIA is capable of converting the parallel data of central microprocessor 30 to serial data for transmission to servo power unit 26. The ACIA's in the preferred embodiment are SCN2661's manufactured by Signetics.

The serial outputs of the ACIA's are transmitted on a conventional RS 232 communication line. The use of serial digital communication such as RS 232 presents a simple, neat and orderly attachment to printing apparatus 12. For example, the RS 232 uses only a very small cable, generally five wires. Retrofit attachments in the prior art, utilizing other forms of communication, require a massive amount of wires which are cumbersome to manage.

In operation, monitoring microprocessor 70 first initializes console monitoring means 34 by, for example, reading the contents of EPROM 71 and clearing RAM 72. EPROM 71, used in a conventional manner, contains preselected information such as instructions which are necessary for the operation of monitoring microprocessor 70. System unit microprocessor 30 then forwards command information on the twelve address lines such that run/halt control means 84 outputs a HALT signal that disables monitoring microprocessor 70 for a short period of time. The address information was initially received by address decoder 82 which generated control signals such as RUN and HALT for run/halt control means 84. System unit microprocessor 30 then forwards address and data information, which are first received respectively by address buffer 80 and data transceiver 78, to RAM 72. These data pertain to the various conditions of operator console 24 such as settings for servo modules 28 and display information for display means 46. In addition, whenever console monitoring means 34 is inadvertently disabled due to a variety of causes, system unit microprocessor 30 will forward address information such that a RESET signal is generated by reset generator means 86 for resetting monitoring microprocessor 70. Similarly, the address information was initially decoded by address decoder 82 before a control signal is forwarded to reset generator means 86.

In performing its functions, monitoring microprocessor 70 forwards address and data information to operator console 24 via monitoring buffer/transceiver 74. The operation of operator console 24 is described below. The various actions of operator console 24 sensed by monitoring microprocessor 70, e.g., the depression of switches 64, as best shown in FIG. 5, are placed in RAM 72. In a conventional manner, system unit microprocessor 30 periodically disables monitoring microprocessor 70 and scans the information recorded in RAM 72. The presence of such recorded responses in RAM 72 as depressed switches 64 causes system unit microprocessor 30 to alter the stored data in RAM 72. These altered data contain commands for monitoring microprocessor 70 to perform when it is once again enabled. One such command is the activation of an audio beeper 122, as described below, which acts as a verification for the operator, indicating that a switch 64 has been depressed.

In addition, the detection by system unit microprocessor 30 of recorded responses in RAM 72 causes microprocessor 30 to generate commands to servo power unit 26. These commands generally require the movement of servo modules 28 in adjusting the gap G between inking blade 16 and inking roller 18. These commands are transmitted to servo power unit 26 by ACIA's 76A through 76D, which convert these commands, which are in the parallel fashion, into the serial fashion The operations of servo power unit 26 and servo modules 28 are described below. Although four ACIA's are illustrated, only one is used in the preferred embodiment to communicate with one servo power unit 26.

The type of commands and information forwarded by system unit 22 includes interpolation of zone information, servo linearity table, etc. More particularly, interpolation is a technique in which the required amount of movement for each servo module 28 or key 190 is taken in light of the operational effect of one of the switches 64 of operator console 24 relative to the position of that servo module 28 or key 190. Since the number of switches 64 corresponds to and represents the number of ink zones for the resultant print, each switch 64 affects one such ink zone. In general, the longitudinal length of conventional inking blade 16 may vary from 20 inches to 78 inches. For example, a 28-inch inking blade may have 24 keys which means that the distance between any two adjacent keys is approximately 1.16 inches. Ink control system 20, however, has 22 switches 64 for affecting 22 ink zones. Each switch 64 is used to affect the ink intensity of one such ink zone. The distance between two switches 64 or two ink zones in a 28-inch printing apparatus is approximately 1.279 inches. Thus, there is a lack of one-to-one correspondence between each ink zone and each key. To alleviate this lack of correspondence, the actual settings for the 22 switches 64 of operator console 24 must be adjusted in such a controlled fashion that the resultant settings of the 24 keys will produce 22 ink zones on the resultant print. Thus, the ink intensity of each of the ink zones is the intensity or setting selected on its corresponding switch 64. The interpolation is performed by a conventional computer computation technique. This interpolation capability permits ink control system 20 to be readily retrofittable with any type of existing printing apparatus irrespective of the size of that apparatus or the number of keys available on that apparatus. Although ink control system 20 includes the interpolation capability, it is, nonetheless, equally useful when interpolation is not necessary such as when the number of keys equals the number of ink zones.

As for linearity, the inherent non-linear results produced by each servo module 28 must be compensated by a look-up table in the memory of system unit 22, as described below.

OPERATOR CONSOLE

As best shown in FIG. 3, operator console 24 comprises system control means 40, input/output control means 42, zone control means 44, and display means 46.

Figure 8:
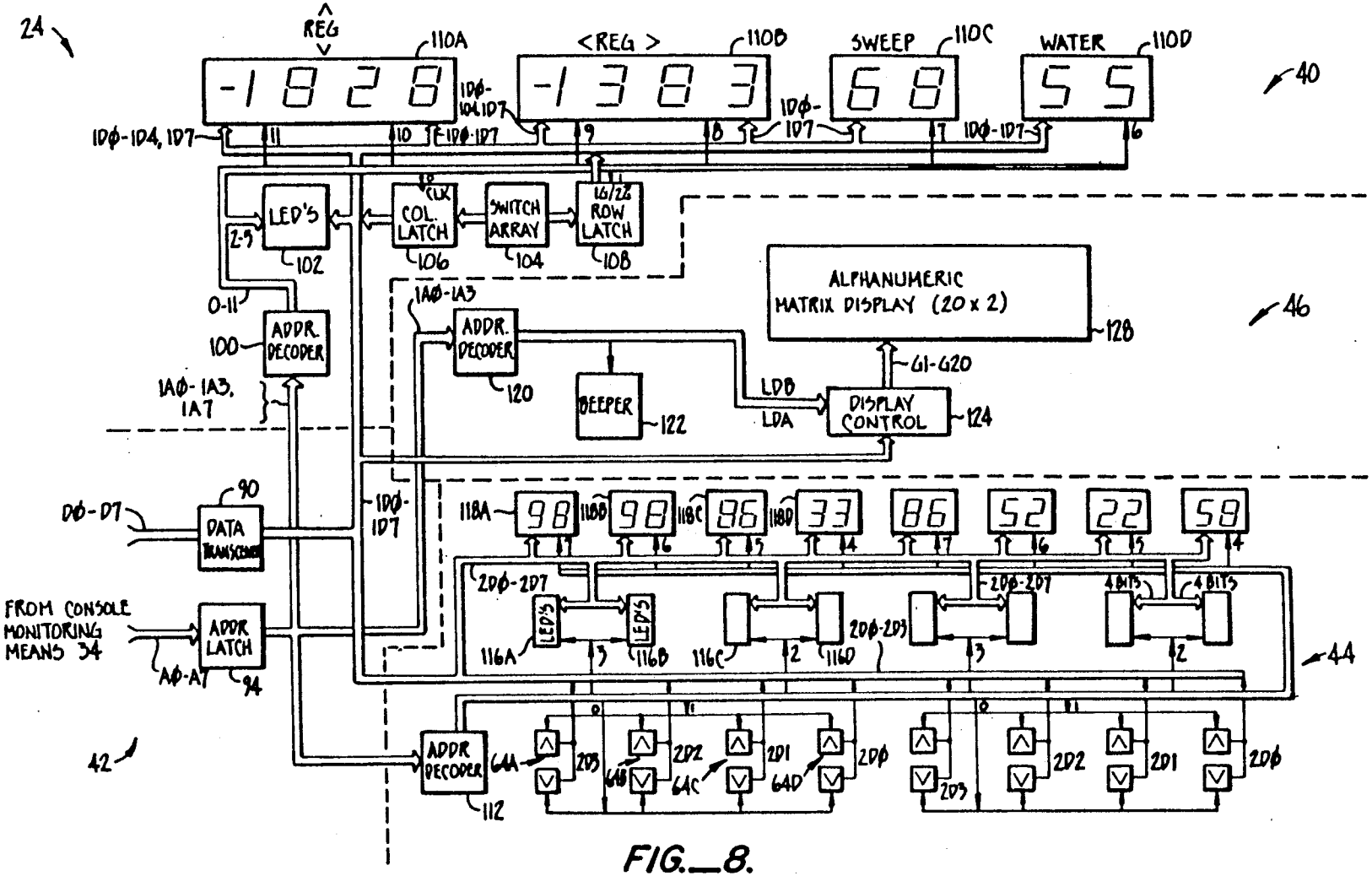
FIG. 8 is a block diagram of the operator console of FIG. 3.

More particularly, as best shown in FIG. 8, signals from console monitoring means 34, as described previously, are first received by input/output control means 42. Input/output control means 42 has a bi-directional data transceiver 90 and an address latch 94 for communicating with console monitoring means 34. Data transceiver 90 and address latch 94 in the preferred embodiment are the 74LS245 transceiver and 74LS273 latch, respectively, manufactured by Signetics.

In addition, system control means 40 comprises an address decoder 100, a plurality of light emitting diodes (LED's) 102, a switch array 104, a column latch 106, and a row latch 108. In particular, address decoder 100 has five inputs which communicate with the five address lines of address latch 94 and twelve address outputs. Address decoder 100 in the preferred embodiment is a 74LS154 decoder manufactured by Signetics.

Switch array 104, a 7×8 array in the preferred embodiment, contains buttons which represent numerals and commands such as ENTER, DELETE, COPY, SAVE, BEGIN, RECALL, etc. Concomitant with some of these buttons are LED's 102; 31 such LED's are provided in the preferred embodiment. The activation of an LED indicates the performance of a command such as COPY. LED's 102 are in communication with four address lines of address decoder and eight data lines of data transceiver 90.

Column latch 106 and row latch 108 are provided for the operation of switch array 104. Column latch 106 and row latch 108 is in communication with the eight columns and seven rows, respectively, of array 104. In addition, column latch 106 and row latch 108 each communicates with eight lines of data transceiver 90 and one address line of address decoder 100. Column latch 106 and row latch 108 in the preferred embodiment are the 74LS374 latch and 74LS244 latch, respectively, manufactured by Signetics.

As described previously, display means 46 comprises a plurality of displays, both alphanumerical and graphical. Since some of the display means 46 are intimately related with each of the subunits of operator console 24, those displays will be described with their associated subunit where appropriate. For example, LED's 102 were described with the operation of switch array 104. Similarly, system control means 40 has associated displays such as the plurality of 7-segment LED displays 110A through 110D. Displays 110A and 110B each is in communication with two address lines of address decoder 100 and data lines of data transceiver 90. Displays 110C and 110D each is in communication with one address line of address decoder 100 and the data lines of data transceiver 90. LED displays 110A through 110D illustrate the functions of REGISTRATION, SWEEP AND WATER, respectively.

Briefly, REGISTRATION, a conventional terminology, denotes the physical alignment of one plate of an image to be printed with respect to another plate. Or, the physical alignment of one color for such an image with respect to other colors of the image. In a conventional color printing apparatus, six fountains are generally used to dispense six color, requiring the use of a plate for each fountain. For example, if an image has a general outline, then all the possible printing colors for that image should be printed not only within that general outline but also in alignment with each other. The lack of registration would create a printed image with colors not confined to that general outline and/or not in alignment with each other. SWEEP, also a conventional terminology, denotes the total quantity of ink on a plate, i.e., the overall intensity of a particular color that is printed on the plate. WATER, a conventional terminology, denotes the dampening of plates to eliminate the adherence of unnecessary ink to the plates. In general, these special functions must be adjusted for each printing run. Although switches 64 are rocker-type switches in the preferred embodiment, other types of switches may also be used such as light pen devices, etc.

Moreover, zone control means 44 comprises an address decoder 112, a plurality of up/down switches 64A through 64D, a plurality LED's 116A through 116D, and a plurality of 7-segment LED displays 118A through 118D. The primary function of zone control means 44 is to enable the selection of settings for servo modules 28. Settings denote the width of gap G between inking blade 16 and inking roller 18. In the preferred embodiment, a setting of 100% means that gap G is at its maximum of approximately 0.012 inch and 0% its minimum of approximately 0.000 inch. As best illustrated in FIG. 8, zone control means 44 comprises displays which are manufactured in groups of fours. For example, four up/down switches 64, four groups of LED's 116, and four displays 118. Thus, only one such group of fours will be described. In addition, since zone control means 44 is configured in this modular fashion, ink control system 20 can be readily expanded or contracted by adding or deleting groups of four switches.

In particular, address decoder 112 has eight inputs which are in communication with address latch 94 and eight outputs. Address decoder 112 in the preferred embodiment is the 74LS138 decoder manufactured by Signetics. As for each of the down switches of up/down switches 64A through 64D, it is in communication with one address line of address decoder 112. Similarly, the up switches are in communication with one address line of address decoder 112.

Figure 6:
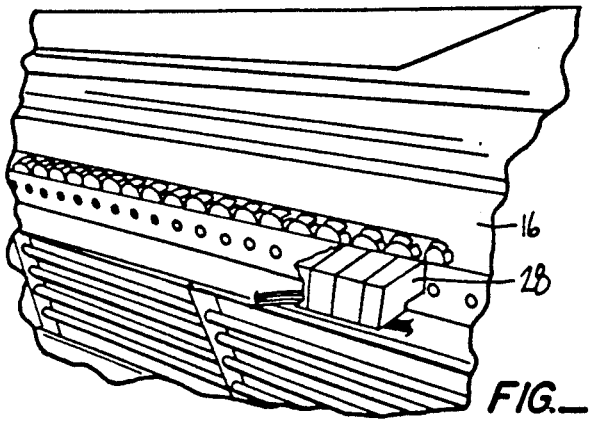
FIG. 6 is a partial, enlarged perspective view of the servo module of FIG. 2.

For graphically displaying the up or down selections of switches 64, LED's 16 and displays 118 are provided. Each group of LED's 116A through 116D is a linear array of eleven LED's positioned in a vertical fashion as best shown in FIGS. 5 and 6. Each group of LED's 116A through 116D includes ten LED's, each LED representing a ten percent increment of a predetermined maximum value. Each group of LED's is in communication with one address line of address decoder 112 and the data lines of data transceiver 90. As described below, each servo module 28 is capable of providing a reference point for itself, and that point is stored in servo power unit 24. Each linear array of LED's 116 represents a range from zero to 100 percent of gap G, the 100 percent being the predetermined maximum value.

Similarly, each of the LED displays 118A through 118D is in communication with one address line of address decoder 112 and the data lines of data transceiver 90. LED displays 118A through 118D are utilized by the operator as the prime method for setting the value for each zone.

Last, the remaining displays of display means 46, as best shown in FIG. 8, comprises an address decoder 120, an audio beeper 122, display control means 124, and an alphanumeric character display 128. Address decoder 120 is in communication with four address lines of address latch 94 and has three output lines one of which is in communication with beeper 122 and the remaining two are in communication with display control means 124. Address decoder 120 in the preferred embodiment is the 74LS138 decoder manufactured by Signetics. Display control means 124, receiving both the address information from address decoder 120 and the data information from data transceiver 90, outputs twenty display signals for display 128. Display control means in the preferred embodiment utilizes the 10938 and 10939 LSI chips manufactured by Rockwell International Corp. of El Segundo, Calif. Display 128 in the preferred embodiment is a 20×2 character dot matrix alphanumeric display manufactured by Noritaki Corp. of Japan.

In operation, address information from console monitoring means 34 of system unit 22 first addresses up/down switches 64 and switch array 104 to determine whether or not one or more of theses switches have been selected. For example, if switch 64A has been selected to increase in value, that information is transmitted to console monitoring means 34 via data transceiver 90. This information is initially recorded in RAM 72, as described previously. During a periodic scan of RAM 72, system unit microprocessor 30 is capable of determining the selection of a new value on switch 64A. Monitoring microprocessor 70 scans the buttons of switch array 104 approximately every 250 milliseconds, and forwards commands via address latch 94 and data transceiver 90 such that beeper 122 is activated. Although beeper 122 can only be activated approximately every 250 milliseconds, after each scan of switch array 104, this rapidity is sufficiently fast to a human operator such that he hears a beep for each selection of switch 64. After decoding by address decoder 112, linear array LED's 116A and display 118A are activated. If the selected advance is greater than ten percent of a previous value, the next higher LED in the linear array is activated. Simultaneously, display 118A advances its numerical display for each advance selected.

If a button on switch array 104 has been selected, that information is transmitted to console monitoring means 34 in a conventional manner by column latch 106 and row latch 108. In turn, monitoring microprocessor 70 then forwards commands via address latch 94 and data transceiver 90 such that the appropriate LED of LED's 102 is activated if that key has an LED. In addition, if one of the three functions of REGISTRATION, SWEEP and WATER is selected, then its corresponding display 110A through 110D is activated to illustrate the selected value. Commands for system control means 40 are decoded by address decoder 100.

Simultaneously, the advances selected on switch array 104 are forwarded to RAM 72, as described previously. System unit microprocessor 30, during its periodic scan, detects these advances and commands the movement of servo modules 28 accordingly, as described below.

Last, if system unit microprocessor 30 is forwarding and requesting responses from the operator, the appropriate message is displayed on alphanumeric character display 128 via monitoring microprocessor 70. Commands for beeper 122 and display 128 are decoded by address decoder 120.

SERVO POWER UNIT

Figure 9:
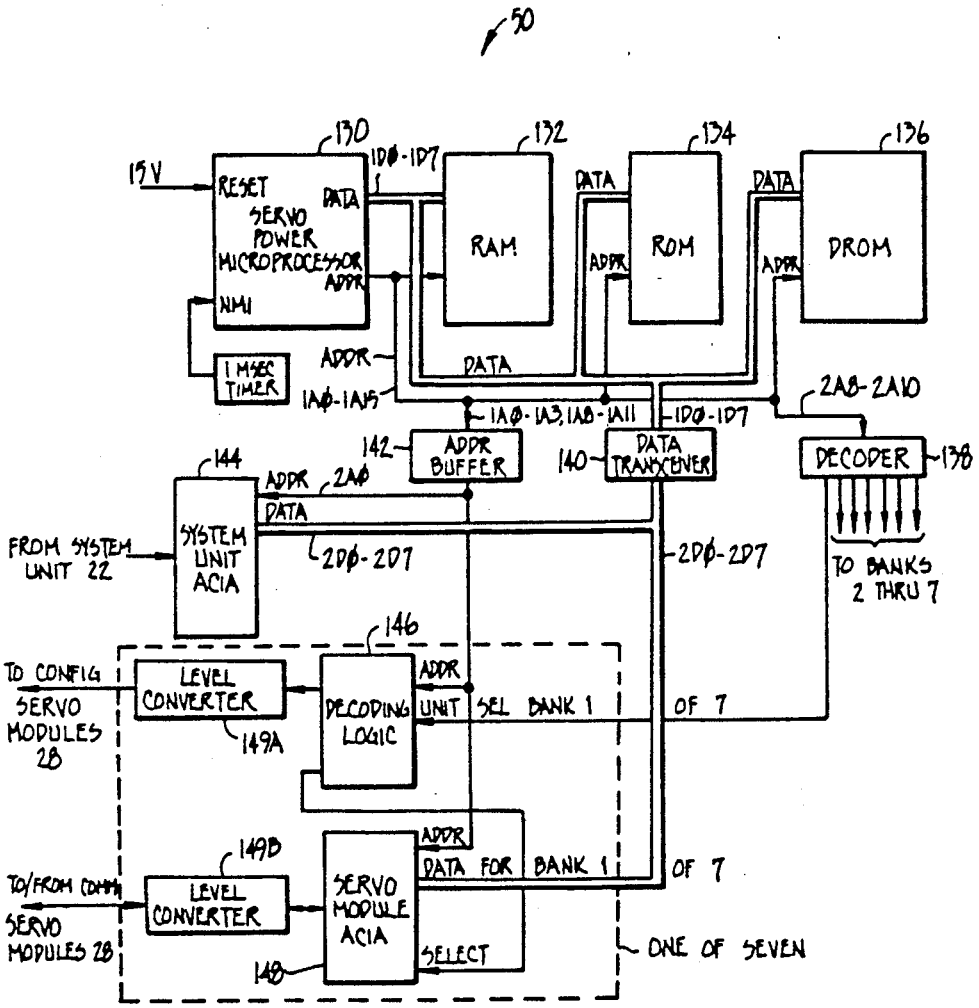
FIG. 9 is a block diagram of the servo power unit of FIG. 3.

Each of the four servo power units 26 comprises servo central processing and communication means 50 and a conventional power supply 52. As best shown in FIG. 9, servo central processing and communication means 50 in turn comprises servo power processing means 130, a random access memory (RAM) 132, a read only memory (ROM) 134, a dedicated read only memory (DROM) 136, a decoder 138, a bi-directional data transceiver 140, an address buffer 142, a system unit communication ACIA 144, decoding logic means 146, a servo module ACIA 148, and level conversion means 149A and 149B.

More particularly, servo power processing means 130 in the preferred embodiment is a 6802 microprocessor manufactured by Motorola. Servo power microprocessor 130 includes 16 address outputs, 8 data outputs, a reset input, and a clock input. RAM 132 and ROM 134 each in the preferred embodiment is a conventional 8-bit, 64K memory device DROM 136 in the preferred embodiment is a conventional 8-bit, 16K memory device. Decoder 138, a 74LS42 decoder manufactured by Signetics, is capable of permitting the transmission of information from servo central processing and communication means 50 to one of seven possible groups or banks of servo modules 28. In the preferred embodiment, only six banks of servo modules 28 are provided, with the remaining group consisting of special functions such as REGISTRATION, WATER, SWEEP, etc.

In addition to its processing functions, servo power microprocessor 130 also controls a phenomenon generally referred to as "coast." Coast is the inherent incapability of a servo module 28 to stop at the exact location where it was inactivated, i.e., where its power was shut off. For example, if system unit 22 requires servo module 28 to rotate four revolutions, it will coast past the point where its power was shut off. Thus, servo power microprocessor 130 records the coasted distance or coast number for each movement of each servo module 28 in order to compensate for it during subsequent movements. This is a dynamic procedure in which the subsequent compensation is generated in light of these coast numbers. For example, due to ageing and other factors, a servo module 28 may coast a certain distance at a particular time of its lifecycle, e.g., when it is new, and coast a different distance after it has been in operation for a long period. This dynamic capability will generate the correct amount of compensation in light its more recent coast numbers, thereby producing a more accurate print.

Moreover, data transceiver 140 and address buffer 142 of the preferred embodiment are the 74LS245 transceiver and 74LS244 buffer, respectively, manufactured by Signetics. Decoding logic 146, also an 74LS42 decoder in the preferred embodiment, is capable of transmitting the enabling signal for one of the seven banks of servo modules 28. The output of decoding logic 146 is elevated by a conventional level converter 149A from 5 volts to 15 volts before the signal is forwarded to a bank of servo modules 28 as the configuration CONFIG signal, as described below. System unit ACIA 144 and servo module ACIA 148 function in a fashion similar to their counterparts in system unit 22. In addition, both system unit ACIA 144 and servo module ACIA 148 are SCN266's manufactured by Signetics. System unit ACIA 144 is capable of receiving information from system unit 22 via RS 232 communication line. Similarly, servo module ACIA 148 is capable of forwarding information from servo power unit 26 to the plurality of servo modules 28 and receiving information from servo modules 28. The information forwarded to servo modules includes the value of the amount of movement, and the received information includes verfication signal indicating whether or not the amount of movement was accomplished, and the actual position of the movement. The output of servo module ACIA 148 is first elevated by a conventional level converter 149B.

In addition to the advantage of neatness and orderliness, as described previously, the use of serial digital communication also facilitates and enhances the modular concept of ink control system 20. Since ink control system 20 is designed for use with existing printing apparatus of varying dimension, the number of servo modules 28 and the size of operator console 24 may be increased or decreased with ease. Parallel and analog communication, as used in prior art attachments, would not only require additional wires and other connectors in order to expand but also be time consuming to reconfigure. Ink control system 20, utilizing serial communication such as buses, is easy to mount or remove and is not a time-consuming operation. Moreover, heavy and cumbersome cables are not required.

In operation, the initialization of a servo power unit 26 causes the pre-selected operational information in DROM 132 to be inputted into RAM 132. As information is received by system unit ACIA 144 from system unit 22, system unit ACIA 144 transforms the information travelling on RS 232 communication line, which is in a serial fashion, into parallel fashion. Such information as address and data are forwarded to RAM 132 and ROM 134. ROM 134, used in a conventional manner, contains preselected information such as instructions which are necessary for the operation of servo power microprocessor 130. The data forwarded by system unit 22 generally includes the movement instructions for servo modules 28, as described previously. Servo power microprocessor 130 then outputs instructions to the appropriate servo modules 28. At this juncture, servo power microprocessor 130 forwards a signal to decoder 138 such that one of the seven banks of servo modules 28 is capable of receiving the instructions. Thus, only one bank of servo modules 28 is capable of receiving and performing the instructions at any one time.

The first set of information forwarded by servo power microprocessor 130 via decoder 138 is the configuration signals. Configuration signals are in essence initialization signals which assign a unique identifier, generally a numeral, to each of the servo modules 28. Thus identified, each servo module 28 is then capable of performing the upcoming instructions that have been selected for that servo module 28. These configuration signals, as described below, are first decoded by decoding logic 146 so as to be forwarded to a particular bank of servo modules 28, and elevated by level converter 149A before they are transmitted to servo modules 28 via the CONFIG line Servo power microprocessor 130 then controls the output of information such as the movement instructions to servo modules 28. These movement instructions are calculated in light of the coast number for each servo module 28 and the actual position of each servo module 28 after the previous movement. Address and data information are first transmitted from RAM 132, via address buffer 142 and data transceiver 140, respectively. These signals, which are in a parallel fashion, are converted to a serial fashion by servo module ACIA 148. The serial outputs of servo module ACIA 148 are elevated by level converter 149B before they are forwarded to servo modules 28 on the servo communication COMM line. Conversely, verification signals transmitted by servo modules 28, travelling also on the COMM line, are received by servo module ACIA 148, transformed to parallel fashion, and forwarded to servo power microprocessor 130 for further processing. Such further processing may include the transmission of the status of servo modules 28, as evidenced by their verification signals, to system unit 22 via system unit ACIA 144. In addition, the verification signals include the coast number for each servo module 28 such that it will be taken into consideration in formulating the subsequent moves for that servo module 28.

Although servo power unit 26 is illustrated and described as an independent subunit of ink control system 20 in the preferred embodiment, it is within the knowledge of one skilled in the art to design a system unit 22 that includes the various functions of servo power unit 26, and thereby eliminate such an independent servo power unit 26. In addition, servo power unit 26 may be designed to communicate with the servo modules 28 on an individual basis, i.e., each servo module 28 being connected by a wire to servo power unit 26.

SERVO MODULE

Figure 10:
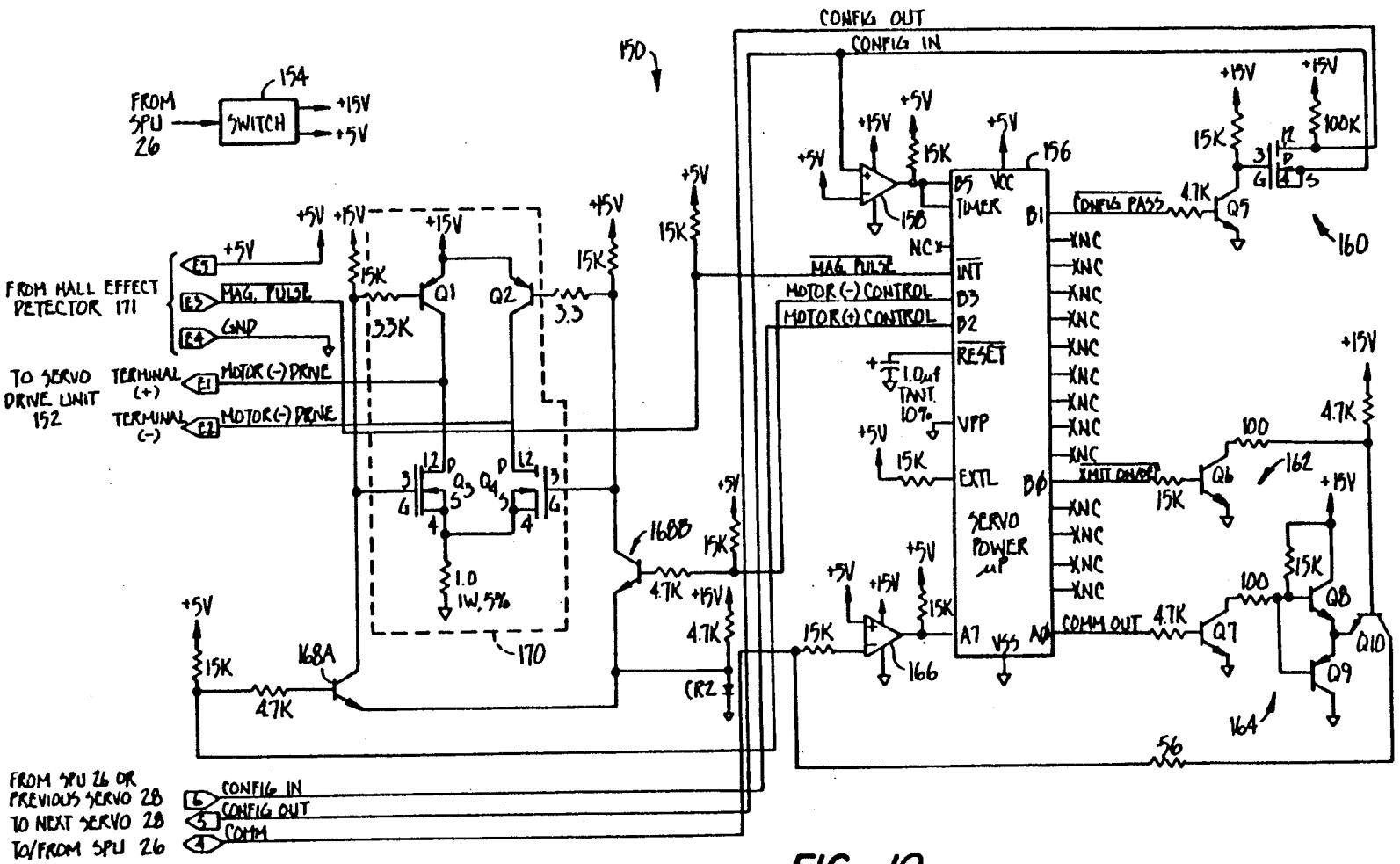
FIG. 10 is a simplified schematic of the servo controller unit of the servo module of FIG. 2.
Figure 19:
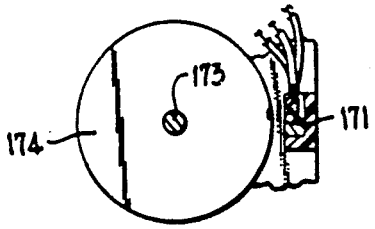
FIG. 19 is a partial, cross section view of the Hall effect detector and the rotating magnet of the servo drive unit of FIG. 11.

Servo module 28 comprises a servo controller unit 150, as best shown in FIG. 10, and a servo drive unit 152, as best shown in FIG. 11. More particularly, servo controller unit 150 includes power supply switch means 154, servo module processing means 156, servo configuration enabling means 158, servo communication control means 160, transmission control means 162, output data transmission means 164, input data entry means 166, a pair of level converter means 168A and 168B, and servo motor driver means 170. In addition, a conventional Hall effect detector 171 is provided, as best shown in FIGS. 11 and 19. In the preferred embodiment, servo module processing means 156 is a 6805 microprocessor manufactured by Motorola. Power supply switch means 154 provides a plurality of voltages. Servo configuration enabling means 158 and input data entry means 166 are comparators. Moreover, devices Q1, Q2, Q3 and Q4 of servo motor driver means 170 are conventional power drivers.

In operation, servo power unit 26 first forwards an enabling signal to a particular servo module 28, permitting that servo module 28 to receive information. This enabling signal, designated as the configuration CONFIG IN signal in the preferred embodiment, is received by servo configuration enabling means 158. Servo configuration enabling means 158, a comparator in the preferred embodiment, permits the passage of this information to servo module microprocessor 156 if it exceeds 5 volts. Servo communication control means 160, a switch in the preferred embodiment, of each servo module 28 is initialized to an open state at the activation of all servo modules 28 by servo power unit 26. As comparator 158 of the first servo module 28 passes the CONFIG IN signal, servo module microprocessor 156 records the identifier contained in the CONFIG IN signal, e.g., numeral "1". Servo module microprocessor 156 then outputs a signal, designated −CONFIG PASS in the preferred embodiment, which activates or closes switch 160. Thus closed, the next CONFIG IN signal passes unaffected through the already-identified servo module 28 as the CONFIG OUT signal, permitting the next servo module 28 to be identified in a similar fashion.

Ink control system 20 is designed such that servo modules 28 are deactivated when they have completed their instructed movements. Power supply switch 154 is used to deactivate and activate servo modules 28. Deactivation of servo modules 28 between instructed movements is desirable for primarily two reasons—to minimize power consumption and to reduce the possibility of electrical noise on the CONFIG line which may generate incorrect data. Thus, servo modules 28 are configured before each and every time that servo power unit 26 forwards movement instructions. Although the CONFIG IN and CONFIG OUT signals are described as if they were separate communication paths, these two signals actually propagate on a single communication path in the preferred embodiment.

Thus enabled, servo module microprocessor 156 is capable of receiving additional information from servo power unit 26 via the communication COMM line. This additional information requests the movement of servo drive unit 152 such that the gap G between inking blade 16 and inking roller 18 is varied. The entry of this additional information into servo module microprocessor 156 is controlled by input data entry means 166. Input data entry means 166, a comparator in the preferred embodiment, permits the transmission of this digital information, using a 5-volt reference.

When servo module microprocessor 156 is transmitting information to servo power unit 26 via the COMM line, a signal is outputted, designated as COMM OUT in the preferred embodiment. For transmitting this output information, output data transmission means 164 is provided. Output data transmission means 164 in the preferred embodiment comprises a plurality of conventional transistors Q7 through Q10. Simultaneously, a transmission signal, designated −XMIT ON/OFF in the preferred embodiment, is outputted by servo module microprocessor 156. This transmission signal causes transmission control means 162 to activate transistor Q10 of output data transmission means 164. This outputted information to servo power unit 26 includes verification signals such as the status of servo module 28—the coast number and the actual position of servo module 28 after the movement.

When servo module microprocessor 156 is controlling the movement of servo drive unit 152, positive or negative digital control signals are generated, determining the direction of motor rotation. The positive and negative control signals are first amplified by the pair of conventional level converters 168A and 168B, respectively. If the positive control signal had been generated by servo module microprocessor 156, the activation of level converter 168A causes transistor Q1 of servo motor driver means 170 to be activated. A current can now flow toward the positive side of the motor drive, designated MOTOR (+) DRIVE in the preferred embodiment. The returning current from the motor drive returns on the MOTOR (−) DRIVE line and passes through active device Q4 of servo motor driver means 170. If servo module microprocessor 156 had generated a negative control signal, the current would travel through servo motor driver means 170 in the reverse fashion, causing the motor to rotate in the opposite direction. The movement of servo drive unit 152 is detected by Hall effect detector 171 the signal for which is designated—MAG PULSE in the preferred embodiment. Accordingly, operation of servo drive unit 152 is controlled by commands which propagate on five communication path—MOTOR (+) DRIVE, MOTOR (−) DRIVE, −MAG PULSE, CONFIG IN/CONFIG OUT, and COMM.

As best shown in FIG. 11, servo drive unit 152 comprises a Hall effect detector 171, conventional motor means 172, a motor shaft 173, a multiple-pole magnet 174 mounted on motor shaft 173, first stage gear means 176, a first drive shaft 177, second stage gear means 178, a second drive shaft 180, first coupling means 182, multi-turn stop means 184, adjusting means 186, second coupling means 188. Second coupling means 188 is attached to a key 190 of an existing printing apparatus 12. Second coupling means 188 is designed such that it is capable of receiving key 190 of any existing printing apparatus 12. In addition, second coupling means 188, a conventional nut and bolt device, may be easily mounted and removed from key 190, thereby contributing to the overall ease in servicing ink control system 20.

Figure 16:
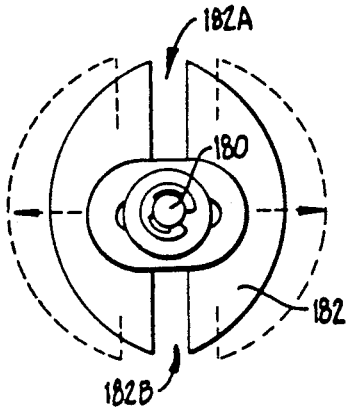
FIG. 16 is a diagrammatical end view of the servo drive unit of FIG. 11.

The configuration and design of first coupling means 182 and second coupling means 188 also contribute to the ease in mounting and operation of ink control system 20. As best shown in FIG. 11, second coupling means 188 includes two rearwardly extending members 188A and 188B. First coupling means 182 in turn includes two radially extending slots 182A and 182B. Since the depth of slots 182A and 182B is greater than the height of members 188A and 188B, this permits members 188A and 188B to slide within slots 182A and 182B, respectively. Similarly, first coupling means 182 is conventionally mounted to slide at a direction perpendicular to the direction of slide of members 188A and 188B, as best shown in FIG. 16. When coupled, first coupling means 182 and second coupling means 188 are capable of being attached to existing key 190 when servo module 28 is not precisely aligned, axially, with key 190. Thus, ink control system 20 is easy to mount since its servo modules need not be aligned precisely and accurately with existing keys 190. Moreover, existing printing apparatus 12 need not be altered in order to receive ink control system 20.

Figure 12:
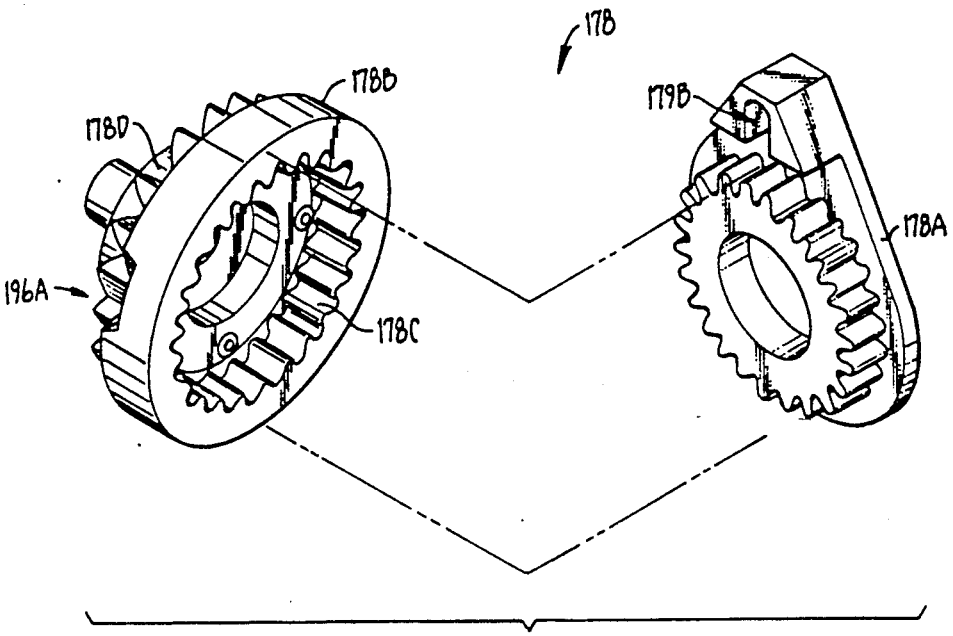
FIGS. 12–15 are enlarged views of the gears of the servo drive unit of FIG. 11.
Figure 15:
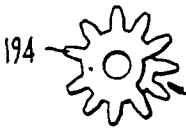

As best shown in FIGS. 12, second stage gear means 178 includes an inner or spur gear 178A and an outer gear 178B. Outer gear 178B can be further categorized as having unexposed gear 178C and exposed gear 178D. Since gear means 176 and 178 are nearly identical with minor differences, as described below, only second gear means 178 will be described. Spur gear 178A is configured such that the diameter of its gear teeth is smaller than the diameter of gear teeth of unexposed gear 178C. The number of gear teeth on either spur gear 178A or unexposed gear 178C is an odd number; in the preferred embodiment 27 and 29 teeth, respectively. This unique arrangement is required in light of the fact that the standard gearing arrangement requires twelve or more teeth differential between the spur gear and the unexposed gear. This unique arrangement is made possible by the unique profile of each gear teeth of gear means 176 and 178 in that each gear teeth is relatively thick as compared to its height. This unique arrangement and profile servo two purposes—gear reduction per stage is greater than that in the prior art; and the greater number of teeth which are in engagement at any given time permits higher torque loads than conventional gearing arrangement. Moreover, this unique arrangement permits the use of low cost injection-molding thermoplastic gears without sacrificing torque or product life.

This configuration creates a 14.5:1 gear reduction ratio in each of the two stages. Since the diameter of the gear teeth of spur gear 178A is smaller than its counterpart in unexposed gear 178C, spur gear 178A revolves in an eccentric fashion as it is being driven by motor shaft 173 and first drive shaft 177, respectively. The lobe of eccentricity equals:

$$\frac{\text{TEETH OF UNEXPOSED GEAR} - \text{TEETH OF SPUR GEAR}}{2 \times \text{TOOTH DIAMETRAL PITCH}}$$

Figure 13:
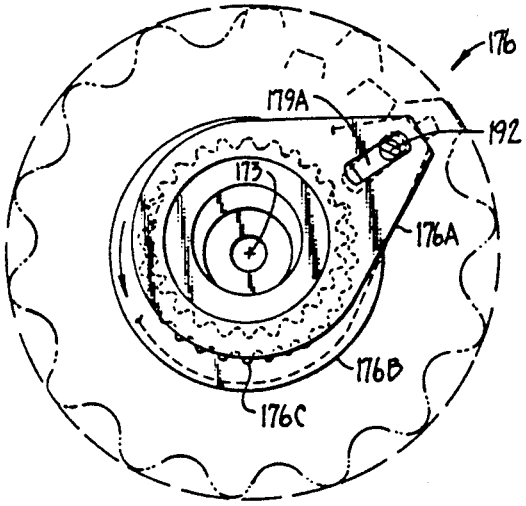
Figure 14:
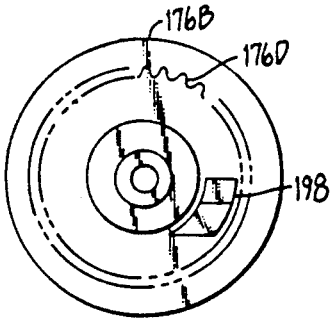

As best shown in FIGS. 11-13, spur gear 178A also includes a vertical-slotted opening 179B. As best shown in FIGS. 13 and 14, first stage gear means 176 similarly includes a spur gear 176A, an outer gear 176B that includes an unexposed gear 176C and an exposed gear 176D, and an opening 179A. Extending through each opening is the shaft 192 of adjusting means 186. As motor shaft 173 and first drive shaft 177 rotate, openings 179A and 179B slide up and down with respect to shaft 192. The overall gear reduction is such that for every 210.25 revolutions of motor shaft 173 and first drive shaft 177, second drive shaft 180 revolves 14.5 revolutions and unexposed gear 178C only revolves one revolution. Thus configured, the rotational torque and resultant force exerted by key 190 onto inking blade 16 is high while servo module 28 is quite compact in relation to prior art adjusting devices. To produce a comparable amount of torque, prior art devices employ planetary gears which are generally more expensive than servo module 28 or employ conventional spur gears which require more space. In addition, servo module 28 is capable of producing such a high torque even when it utilizes second stage gear means 178 that is manufactured from a plastic material.

Although the resultant output rotation of servo module 28, i.e., the output rotation of first coupling means 182, is not linear, conventional compensation technique is provided by system unit 22. A look-up table is stored in the memory of system unit 22 such that the appropriate number of rotations forwarded to servo module 28 is generated after taking into account the non-linear aspects of gear means 176 and 178.

Figure 17:
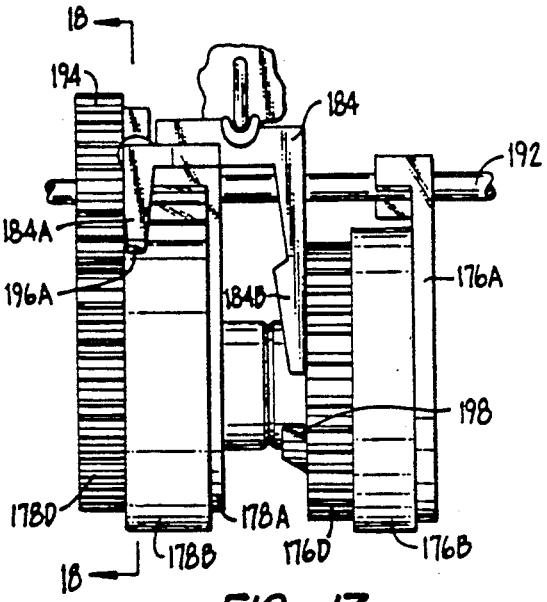
FIG. 17 is a partial, enlarged side view of the various members of the servo drive unit of FIGS. 11–15 for performing the calibration and braking operations.
Figure 18:
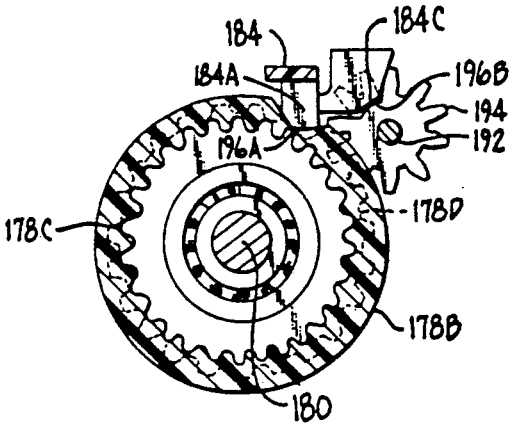
FIG. 18 is a partial, enlarged cross section view of the members of FIG. 17.

In addition, gear means 176 and 178 also facilitate the calibration of servo module 28. As best shown in FIGS. 11, 17 and 18, a calibration gear 194 is provided. Exposed gear 178D and calibration gear 194 each includes a notch 196A and 196B, respectively. In addition, multi-turn stop means 184 includes a calibration arm 184A, a brake arm 184B and a calibration cam 184C. During calibration, signals forwarded by system unit microprocessor 30 causes gear means 178 to rotate such that the coincidence of the two notches 196A and 196B with calibration arm 184A and calibration cam 184C, respectively, causes brake arm 184B to contact a brake extension 198 of gear means 176, as best shown in FIGS. 14, 17 and 18. The termination of the rotation of gear means 176 and 178 is designated as a reference by system unit microprocessor 30. In the preferred embodiment, calibration gear 194 has a prime number of eleven teeth and exposed gear 178D has a prime number of 23 teeth. The probability that notch 196A meets calibration arm 184A at the same time that notch 196B meets calibration cam 184C occurs only once for every eleven revolutions of exposed gear 178D, thereby permitting a wide adjustment of key 190.

As described previously, this reference is generally referred to as the zero level from which all advances are selected on switches 64. This calibration procedure, selected by the operator, is necessary in order to reestablish a reference position after the reactivation of servo modules 28 Moreover, the braking aspect of servo module 28 has multiple turns capabality, i.e., motor 172 would not be stopped by brake extension 198 when it is placed into a reverse direction. Further, the placement of brake extension 198 on first stage gear means 176 permits two advantages—braking occurs at a position of lower torque to prevent damage to braking arm 184B, and a greater positional precision since the mechanical tolerance is more favorable at the first stage. Although two stages of gears are described in the preferred embodiment, it is within the knowledge of one skilled in the art to generate the resultant torque utilizing multiple stages of gears. Multi-turn stop means 184 and brake extension 198 perform the added function of acting as a fail-safe mechanism to prevent the uncontrolled drive of key 190 into inking blade 16. Since existing adjusting devices do not employ any such fail-safe technique, many existing printing apparatus are susceptible to damage, especially those which are manually adjusted. The fail-safe mechanism of ink control system 20 actually preserves and enhances the useful lifetime of inking blades 16, inking rollers 18, etc.

In the instance of servo module failure, adjusting means 186 may be manually pulled such that manual gear 199 engages exposed gear 176D, permitting the manual adjustment of key 190. To measure the rotation of motor shaft 173, Hall effect detector 171 is used. As best shown in FIG. 18, Hall effect detector 171 is capable of detecting the multiple poles of rotating magnet 174, thereby producing a corresponding number of pulses for each revolution of motor shaft 173. Servo module microprocessor 156 counts these pulses and moves motor 172 the required number of pulses as required by the instructions from servo power unit 26. Thus, Hall effect detector 171 functions as a simple feedback device in detecting the movement of servo module 28. Adjusting devices in the prior art generally utilize cumbersome detection devices to sense the actual movement of inking blade 16. Such detection devices include potentiometer devices In addition, the detected rotations of servo module 28 also inform servo power unit 26 as to the coast number for that servo module.

Although Hall effect detector 171 is used in the preferred embodiment to verify that the number of rotations of motor 172 is exactly as commanded by servo power unit 26, other feedback devices may be substituted. For example, a conventional absolute position encoder Such as the HEDS-6000 optical encoder manufactured by Hewlett Packard Co. of Palo Alto, Calif., may be used. Or, a potentiometer may also be used.

Since the electronics and mechanical elements for each servo module 28 are enclosed as a single package, this packaging also contributes to the modular concept of ink control system 20 in that all servo modules 28 are interchangeable. This interchangeability permits rapid and easy maintenance and replacement. The physical dimensions of servo module 28 are as follows: approximately 0.985 inch in width; approximately 2 3/16 inches in height; and approximately 3½ inches in length.

OVERALL OPERATION

Figure 20:
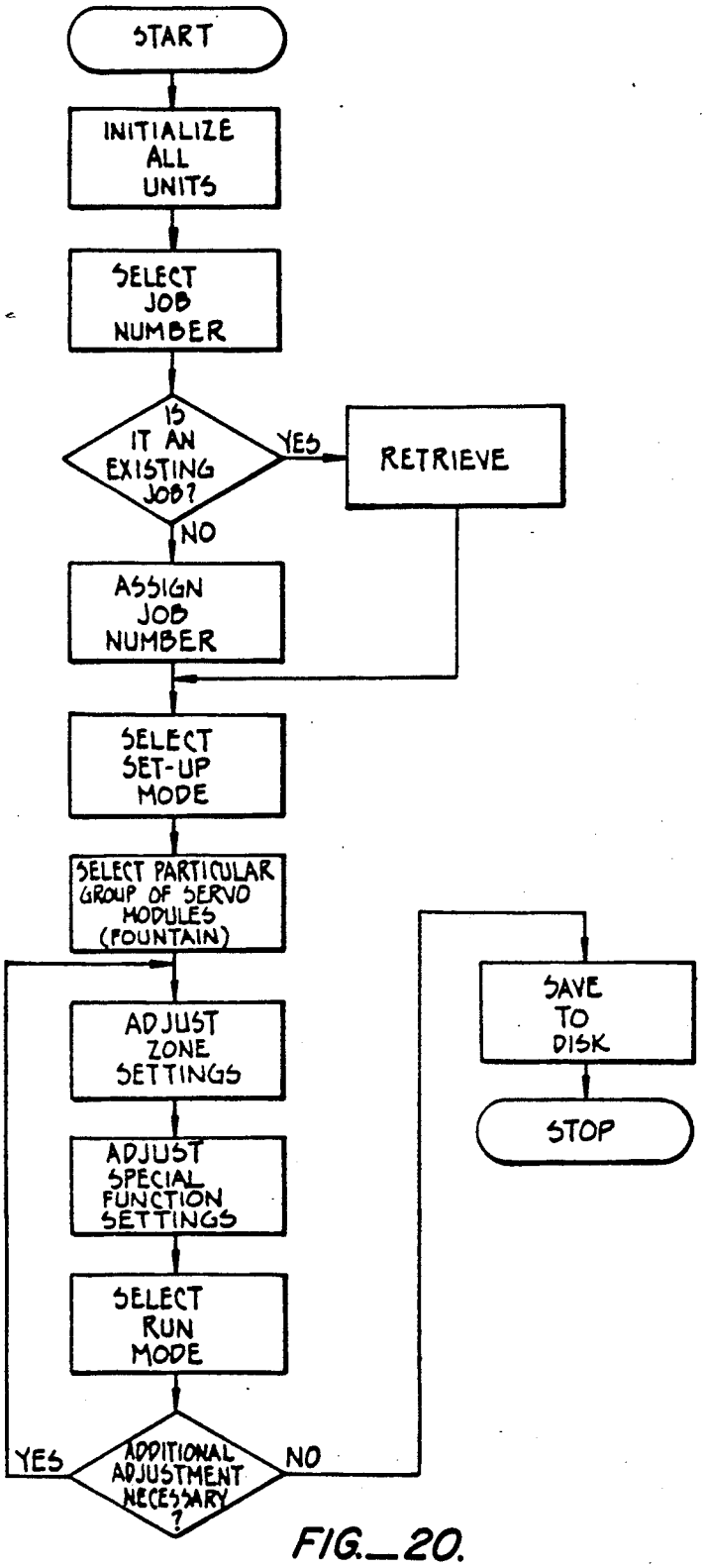
FIG. 20 is a flow diagram of the operation of the ink control system of FIG. 3.

As best illustrated in FIG. 20, the overall operation of ink control system 20 is activated by an operator. At this power-on stage, system unit microprocessor 30 forwards the appropriate signals to initialize all subunits. Then, the operator may wish to calibrate all servo modules 28 by setting all zeros on switches 64 of zone control means 44. If the operator wishes to print an image the data for which have already been set up and stored in system unit 22, he retrieves that particular job number by selecting the RECALL button of switch array 104 of operator counsel 24. In such an instance, the stored data such as the required settings of servo modules 28 are retrieved from disc memory and forwarded to operator console 24 The operator may or may not perform further adjustments of the settings before forwarding them to servo modules 28. In other instances, however, the operator needs to select the appropriate settings for servo modules 28 on operator console 24.

To begin a new job, a new job number is assigned In addition, the operator at this juncture selects the particular bank of servo modules 28 out of the six possible selections by depressing one button of switch array 104. Each bank of servo modules 28 is mounted on one fountain 14 that is capable of dispensing one color. In an alternative embodiment, as best shown in FIG. 5, a plurality of bank switches 103 are provided.

While in SET-UP mode, only system unit 22 and operator console 24 are in operation, permitting the operator to select the various buttons of switch array 104 and other special function buttons such as REGISTRATION, SWEEP and WATER without activating servo power unit 26 and servo modules 28. Generally, a plate 60 is placed on platform 62 to permit easy viewing by the operator of the image to be printed. The operator then selects the appropriate numerical settings for each ink zone of the plate on operator console 24. For each zone, the operator selects the appropriate value by depressing switches 64. For example, as best shown in FIG. 8, if the operator is advancing switch 64A, each single advance is shown on 7-segment LED display 118A. This advance is forwarded to RAM 72 of console monitoring means 34. During its periodic scan of RAM 72, system unit microprocessor 30 detects these selections stored in RAM 72. System unit microprocessor 30 then alters the stored data such that monitoring microprocessor 70 will subseguently activate audio beeper 122, audially verifying the depression of switch 64A. For every ten advances or steps selected by switch 64A, an additional LED on the linear array of LED 116A is activated. The linear array of LED 116A, thus, displays a graphical illustration of the selected value.

If the operator wishes to advance the entire group of switches 64, he may select ALL switch 65, as best shown in FIG. 5, which will advance an identical value for every zone. The operator may also select a percentage switch such that each of the zone settings is advanced by the selected percentage. For example if zone number one has been set at 50 and zone number two at 30, the selection of an advance of 10% in ink intensity on the percentage switch advances zone number one to 55 and zone number two to 33. In contrast, the selection of a value, e.g., 10, on ALL switch 65 would advance zone number one to 60 and zone number two to 40.

Similarly, the operator may select the appropriate values for the special functions REGISTRATION, SWEEP and WATER. Although selecting the special function values may be performed by depressing the appropriate buttons on switch array 104, as described previously, an alternative embodiment is illustrated in FIG. 5. The alternative embodiment utilizes a plurality of up/down switches 111A, 111C and 111D for selecting the values. Switches 111A, 111C and 111D function and operate in a fashion identical to that for switches 64.

Plates 60 are then mounted on fountains 14. The operator then selects the RUN mode switch. The settings for the bank of servo modules 28 and the concomitant special function settings, which are stored in RAM 72, are forwarded by system unit microprocessor 30 to servo power unit 26. The movement information to servo modules 28 are generated in light of the nonlinearity of the servo module output. As described previously, the selected values for the zones and special functions are first forwarded from operator console 24 to RAM 72 of console monitoring means 34. Upon detection by system unit microprocessor 30 during its periodic scan, these zone values and special function values are first retrieved, adjusted, and then forwarded to servo power unit 26.

In servo power unit 26, decoder 138 first decodes the information and forward the information to the appropriate bank of servo modules 28. As described previously, servo modules 28 are first configured and information forwarded to them. Servo module microprocessor 156 then activates motor 172 and orders the appropriate number of movement. The operator will re-adjust the settings after viewing some of the initial prints which are placed on platform 62. The verification signals include the actual position of each servo module 28 after the movement and the coast number of each servo module 28. These are stored in servo power microprocessor 130. In addition, servo modules 28 are deactivated until the operator decides whether additional adjustments are necessary.

If the operator wishes to adjust further servo modules 28, he then first selects the new values on operator console 24. Receiving the movement information from system unit 22, servo power microprocessor 130 then computes the actual amount movement necessary in light of the coast number and the present position of each servo module 28.

If the operator is satisfied with the print, he may then select the LOCK button on switch array 104 to preserve all of the selected values of operator console 24. The operator may also wish to store all of the selected values for future uses by selecting the SAVE button on switch array 104. Moreover, the operator, by using the COPY function, may copy the settings for one unit or bank to another unit Or, he could exchange the settings for one bank to another bank, effecting the the intensity of another fountain or color Once a particular image is on the printing apparatus, the operator may select and adjust values for other printing jobs while the first job is running.

It will be apparent to those skilled in the art that various modifications may be made within the spirit of the invention and the scope of the appended claims. For example, the seventh bank of each servo power unit 26 may include other accessories such as plate scanners, scanning densitometers, office equipment, etc. In addition, ink control system 20 may be connected to a non-continuous or segmented inking blade 16. Moreover, ink control system 20 may be designed such that servo modules 28 need not be configured before each instruction. For example, a conventional hardwired jumper switch may be used to identify each servo module such that the configuration procedure of assigning a particular identifier may be eliminated. In such a system, the concomitant decoding steps are also eliminated When appropriate, system unit 22 may utilize other conventional communication techniques Further, since ink control system 20 is easy to attach to an existing printing apparatus 12, it is equally easy to remove from the existing printing apparatus 12 and connected to another printing apparatus. This capability is especially attractive when the operator wishes to discard a printing apparatus that has reached its lifecycle and connect the ink control system to a newly-purchased printing apparatus.

We claim:

1. For use with a printing apparatus that includes at least one ink fountain for dispensing ink to an associated printing roller and an inking blade positioned adjacent to the printing roller such that a gap exists between the inking blade and the roller, the inking blade having a plurality of adjusting keys associated therewith for adjusting the gap at discrete locations along the length of the inking blade such that the printing apparatus imprints a resultant print having a plurality of printing zones, an ink control system comprising:

(a) a plurality of servo modules connected to the plurality of adjusting keys in 1:1 correspondence such that each servo module actuates its corresponding adjusting key;

(b) an operator console including a plurality of input switches for generating a plurality of ink intensity commands wherein each ink intensity command relates to the intensity of ink to be applied to the resultant print within an associated printing zone, the plurality of ink intensity commands being equal in number to the plurality of printing zones; and (c) a system control unit which receives the ink intensity commands from the operator console and which includes means for interpolating between the plurality of servo modules and the plurality of ink intensity commands to generate interpolated servo signals to the servo modules for driving the servo modules to interpolated activation of the adjusting keys such that the ink intensity in each of the printing zones of the resultant print corresponds to the ink intensity command selected on its associated input switch.

2. An ink control system as claimed in claim 1 wherein the plurality of input switches is unequal to the plurality of servo modules.

3. For use with a printing apparatus that includes at least one ink fountain for dispensing ink to an associated printing roller and an inking blade positioned adjacent to the printing roller such that a gap exists between the inking blade and the roller, the inking blade having a plurality of adjusting keys associated therewith for adjusting the gap at discrete locations along the length of the inking blade such that the printing apparatus imprints a resultant print having a plurality of printing zones, an ink control system comprising:

(a) a plurality of servo modules connected to the adjusting keys in 1:1 correspondence such that each servo module activates its corresponding adjusting key;

(b) an operator console for providing ink intensity command values for controlling the operation of the servo modules;

(c) a servo power unit responsive to the ink intensity command values received from the operator console to provide signals to the servo modules for adjusting individual adjusting keys an amount corresponding to the corresponding ink intensity command value;

(d) means for monitoring the adjustment of the adjusting keys to determine whether the individual adjusting keys have been adjusted the amount corresponding to the corresponding ink intensity command value; and (e) means for recording the difference between the amount of actual adjustment by individual adjusting keys and the amount corresponding to the corresponding ink intensity command value after each adjustment thereof and for providing update signals to the servo modules such that the differences are compensated for on subsequent adjustments.

4. For use with a printing apparatus that includes at least one ink fountain for dispensing ink to an associated printing roller and an inking blade positioned adjacent to the printing roller such that a gap exists between the inking blade and the roller, the inking blade having a plurality of adjusting keys associated therewith for adjusting the gap at discrete locations along the length of the inking blade such that the printing apparatus imprints a resultant print having a plurality of printing zones, an ink control system connected to the adjusting keys for controlling the adjustment of the adjusting keys, the ink control system comprising:

(a) a system unit for controlling the operation of the ink control system;

(b) an operator console for providing ink intensity commands to the system unit for controlling the adjustment of the adjusting keys;

(c) a plurality of servo modules connected to the adjusting keys in 1:1 correspondence such that each servo module actuates a corresponding adjusting key, the servo modules being grouped into a plurality of servo module banks, each of the servo module banks including at least one servo module;

(d) a servo power unit for controlling the adjustment of the adjusting keys, the servo power unit comprising:

(i) means for generating a servo select signal for selecting one of the servo module banks for transmission of control signals thereto; and (ii) means for receiving the servo select signal and for transmitting a configuration signal to the selected servo module bank whereby the configuration signal assigns a unique identifier to each of the servo modules within the selected servo module bank; and (e) means for generating the configuration signal.

5. For use with a printing apparatus that includes at least one ink fountain for dispensing ink to an associated printing roller and an inking blade positioned adjacent to the printing roller such that a gap exists between the inking blade and the roller, the inking blade having a plurality of adjusting keys associated therewith for adjusting the gap at discrete locations along the length of the inking blade such that the printing apparatus imprints a resultant print having a plurality of printing zones, an ink control system connected to the adjusting keys for controlling the adjustment of the adjusting keys, the ink control system comprising:

(a) system control means responsive to ink intensity commands for controlling the adjusting of the adjusting keys;

(b) a plurality of servo modules connected to the adjusting keys in 1:1 correspondence such that each servo module actuates a corresponding adjusting key, the servo modules being grouped into a plurality of servo module banks, each of the servo module banks including at least one servo module;

(c) servo control means for controlling the adjustment of the adjusting keys, the servo control means comprising:

(i) means for generating a servo select signal for selecting one of the servo module banks for transmission of control signals thereto; and (ii) means for receiving the servo select signal and for transmitting a configuration signal to the selected servo module bank whereby the configuration signal assigns a unique identifier to each of the servo modules within the selected servo module bank; and (d) means for generating the configuration signal.

* * * * *